US009944490B2

(12) United States Patent
Saito et al.

(10) Patent No.: US 9,944,490 B2
(45) Date of Patent: Apr. 17, 2018

(54) APPARATUS AND METHOD FOR SHEET FOLDING AND SHEET BENDING

(71) Applicants: Satoshi Saito, Kanagawa (JP); Tomohiro Furuhashi, Kanagawa (JP); Michitaka Suzuki, Kanagawa (JP); Tomomichi Hoshino, Kanagawa (JP)

(72) Inventors: Satoshi Saito, Kanagawa (JP); Tomohiro Furuhashi, Kanagawa (JP); Michitaka Suzuki, Kanagawa (JP); Tomomichi Hoshino, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/644,502

(22) Filed: Mar. 11, 2015

(65) Prior Publication Data

US 2015/0266697 A1 Sep. 24, 2015

(30) Foreign Application Priority Data

Mar. 18, 2014 (JP) ..... 2014-055638
Aug. 4, 2014 (JP) ..... 2014-158969

(51) Int. Cl.
*B65H 37/06* (2006.01)
*B65H 45/14* (2006.01)

(52) U.S. Cl.
CPC ..... *B65H 45/147* (2013.01); *B65H 45/14* (2013.01); *B65H 2801/27* (2013.01)

(58) Field of Classification Search
CPC ..... B65H 37/06; B65H 45/147; B65H 45/14
USPC ..... 270/32, 39.06, 45
See application file for complete search history.

(56) References Cited

U.S. PATENT DOCUMENTS 4,504,259 A * 3/1985 Lindenmuller ..... B65H 45/12 493/23
4,997,175 A * 3/1991 Hashida ..... B65H 45/12 270/45
5,092,832 A * 3/1992 Crowley ..... B31F 1/08 493/14

(Continued)

FOREIGN PATENT DOCUMENTS

JP 01-111662 7/1989
JP 2003063734 A 3/2003

(Continued)

OTHER PUBLICATIONS

Extended European Search Report dated Jul. 20, 2015.

*Primary Examiner* — Patrick H Mackey
(74) *Attorney, Agent, or Firm* — Harness, Dickey & Pierce, P.L.C.

(57) ABSTRACT

A sheet is nipped and held by first and second bend forming rollers of which rotation axes are in a direction perpendicular to a sheet conveying direction, the conveying speed of the held portion is made lower than a sheet conveying speed on the upstream side so that a bend is formed on the sheet, the sheet is conveyed toward the bend forming rollers such that the sheet conveying direction to the bend forming rollers passes through a line segment from the rotation axis of the first bend forming roller to a predetermined position on a surface of the first bend forming roller, and the bend formed on the conveyed sheet is pressed from the surface of the sheet in a position on the opposite side of the second bend forming roller with respect to the position where the sheet is in contact with the first bend forming roller.

10 Claims, 12 Drawing Sheets

(56) References Cited

U.S. PATENT DOCUMENTS

| | | | | | |
|---|---|---|---|---|---|
| 5,364,332 | A * | 11/1994 | Gray, Jr. | B65H 45/14 | 493/23 |
| 5,490,829 | A * | 2/1996 | Beord | B65H 45/14 | 493/419 |
| 6,024,682 | A * | 2/2000 | Mandel | B65H 45/144 | 270/32 |
| 6,730,010 | B2 * | 5/2004 | Yamakawa | B65H 45/12 | 493/267 |
| 7,658,372 | B2 * | 2/2010 | Kubo | B65H 37/04 | 270/32 |
| 8,534,660 | B2 * | 9/2013 | Honda | B31F 1/00 | 270/32 |
| 2006/0180970 | A1 * | 8/2006 | Mimura | B65H 45/142 | 270/32 |
| 2012/0261872 | A1 * | 10/2012 | Kagami | B65H 45/12 | 270/45 |
| 2014/0141956 | A1 | 5/2014 | Suzuki et al. | | |
| 2014/0171283 | A1 | 6/2014 | Furuhashi et al. | | |
| 2014/0179504 | A1 | 6/2014 | Nakada et al. | | |
| 2014/0336031 | A1 | 11/2014 | Suzuki et al. | | |
| 2015/0031520 | A1 | 1/2015 | Nakada et al. | | |

FOREIGN PATENT DOCUMENTS

| | | | |
|---|---|---|---|
| JP | 2005008333 | A | 1/2005 |
| JP | 2006-117383 | | 5/2006 |
| JP | 2014-101164 | | 6/2014 |
| WO | WO-9822278 | A1 | 5/1998 |

* cited by examiner

APPARATUS AND METHOD FOR SHEET FOLDING AND SHEET BENDING

CROSS-REFERENCE TO RELATED APPLICATIONS

The present application claims priority to and incorporates by reference the entire contents of Japanese Patent Application No. 2014-055638 filed in Japan on Mar. 18, 2014 and Japanese Patent Application No. 2014-158969 filed in Japan on Aug. 4, 2014.

BACKGROUND OF THE INVENTION

1. Field of the Invention

The present invention relates to a sheet processing apparatus and a sheet processing method and, more particularly, to a folding operation on a sheet.

2. Description of the Related Art

In recent years, there has been a tendency to promote information computerization, and image processing devices, such as printers or facsimile machines that are used to output computerized information and scanners that are used to computerize documents, are essential devices. Such an image processing device has an image capturing function, an image forming function, a communication function, or the like, so that it is often configured as a multifunction peripheral that can be used as a printer, facsimile machine, scanner, or copier.

Out of the above multifunction peripherals, there are known multifunction peripherals that include a folding processing apparatus that, after an image formation is performed on a fed sheet so that an image is drawn, performs a folding operation on the sheet on which the image has been formed.

In this kind of folding processing apparatuses, when a folding operation is performed on a sheet on which an image has been formed, the sheet is conveyed to a dedicated conveyance path for preparing for a folding operation that is to be performed on the sheet, and an end of the conveyed sheet is brought into contact with a stopper that is located on the downstream side of the conveyance path so that a folding position is adjusted and a bend is formed. Then, in the folding processing apparatus, while the sheet is in contact with the stopper on the above-described dedicated conveyance path, it is further conveyed so that the bent portion is guided and pushed into a folding processing unit, and the pushed bend on the sheet surfaces is nipped by the folding processing unit, whereby a folding operation is performed (see, for example, Japanese Patent Application Laid-open No. 2006-117383).

As described above, conventional folding processing apparatuses have a problem in that the above-described dedicated conveyance path or stopper is needed, the space for installing them is needed so that the size of the apparatus is increased, the number of driving systems or control systems for driving them is increased so that the apparatus becomes complicated, and the initial costs and running costs are increased.

In view of the above problem, there is a need to provide a folding processing apparatus that performs a folding operation on sheets with a small-sized and simple configuration at low costs.

SUMMARY OF THE INVENTION

It is an object of the present invention to at least partially solve the problems in the conventional technology.

According to the present invention, there is provided a sheet processing apparatus that forms a folding line on a conveyed sheet, the sheet processing apparatus comprising: a bend forming unit that uses a first bend forming roller and a second bend forming roller that rotate around rotation axes that are in a direction that is perpendicular to a conveying direction of the sheet and that is parallel to a surface of the sheet to nip and hold both surfaces of the conveyed sheet and form a bend on the sheet by making a conveying speed of a held portion lower than a conveying speed of the sheet on an upstream side; a conveying unit that conveys the sheet toward the bend forming unit; and a folding line forming unit that forms a folding line on the sheet, wherein the conveying unit conveys the sheet toward the bend forming unit such that a conveying direction of the sheet that is conveyed toward the bend forming unit passes through a line segment from the rotation axis of the first bend forming roller to a predetermined position on a surface of the first bend forming roller, the predetermined position is, out of a tangent line from a delivery position for delivering the sheet in the conveying unit to a surface of the first bend forming roller, a contact point between a tangent line on a side of the second bend forming roller and a surface of the first bend forming roller, and the folding line forming unit is located on an opposite side of the second bend forming roller with respect to a position where the sheet is in contact with the first bend forming roller after the sheet is conveyed toward the bend forming unit, and the folding line forming unit presses the bend formed on the conveyed sheet from the surface of the sheet so as to form a folding line on the sheet.

The present invention also provides a sheet processing apparatus that forms a folding line on a conveyed sheet, the sheet processing apparatus comprising: a bend forming unit that uses a first bend forming roller and a second bend forming roller that rotate around rotation axes that are in a direction that is perpendicular to a conveying direction of the sheet and that is parallel to a surface of the sheet to nip and hold both surfaces of the conveyed sheet and form a bend on the sheet by making a conveying speed of a held portion lower than a conveying speed of the sheet on an upstream side; a conveying unit that conveys the sheet toward the bend forming unit such that, when a vector in a conveying direction of the sheet that is conveyed to the bend forming unit is decomposed into vectors in a direction of a tangent line at a contact point between a conveyance path of the sheet and a surface of the first bend forming roller and in a direction perpendicular to the tangent line, the vector in the direction of the tangent line includes a component in a direction from the contact point toward the second bend forming roller; and a folding line forming unit that is located on an opposite side of the second bend forming roller with respect to the contact point and that presses the bend formed on the conveyed sheet from the surface of the sheet so as to form a folding line on the sheet.

The present invention also provides a sheet processing method for forming a folding line on a conveyed sheet, the sheet processing method comprising: nipping and holding both surfaces of the conveyed sheet by using a first bend forming roller and a second bend forming roller that rotate around rotation axes that is in a direction that is perpendicular to a conveying direction of the sheet and that is parallel to a surface of the sheet and forming a bend on the sheet by making a conveying speed of a held portion lower than a conveying speed of the sheet on an upstream side; conveying the sheet toward the bend forming unit such that a conveying direction of the sheet that is conveyed to a bend forming unit that forms the bend passes through a line segment from the rotation axis of the first bend forming roller to a predetermined position on a surface of the first bend forming roller; forming a folding line on the sheet by pressing the bend formed on the conveyed sheet from a surface of the sheet in a position on an opposite side of the second bend forming roller with respect to a position where the sheet is in contact with the first bend forming roller after the sheet is conveyed toward the bend forming unit; and the predetermined position is, out of a tangent line from a delivery position for delivering the sheet in the conveying unit that conveys the sheet toward the bend forming unit to a surface of the first bend forming roller, a contact point between a tangent line on a side of the second bend forming roller and a surface of the first bend forming roller.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of the present invention is explained below in detail with reference to the drawings. In the present embodiment, an explanation is given by using, for example, an image forming apparatus that includes a folding processing unit that, after an image formation is performed on a fed sheet, such as paper, to draw an image, performs a folding operation on the sheet on which the image has been formed.

Figure 1:
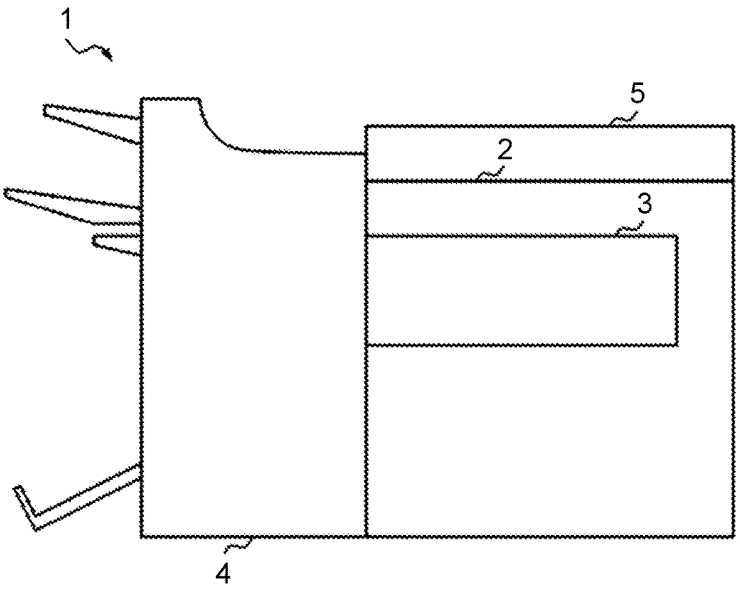
FIG. 1 is a diagram that illustrates the overall configuration of an image forming apparatus according to an embodiment of the present invention in a simple manner.

First, an explanation is given, with reference to FIG. 1, of the overall configuration of an image forming apparatus 1 according to the present embodiment. FIG. 1 is a diagram that illustrates the overall configuration of the image forming apparatus 1 according to the present embodiment in a simple manner. As illustrated in FIG. 1, the image forming apparatus 1 according to the present embodiment includes an image forming unit 2, a folding processing unit 3, an additional-folding processing unit 4, and a scanner unit 5.

The image forming unit 2 generates cyan magenta yellow key plate (CMYK) drawing information based on input image data and, on the basis of the generated drawing information, conducts an image formation output on a fed sheet. The folding processing unit 3 performs a folding operation on a sheet that is conveyed from the image forming unit 2 and that has an image formed thereon. Specifically, according to the present embodiment, the folding processing unit 3 serves as a sheet processing apparatus. The configuration included in the folding processing unit 3 is one of the aspects according to the present embodiment. The additional-folding processing unit 4 performs an additional folding operation on a folding line that is formed on a sheet that is conveyed from the folding processing unit 3 and on which a folding operation has been performed.

The scanner unit 5 computerizes an original document by reading the original document by using a linear image sensor in which multiple photo diodes are arranged in a row and, in parallel to them, light receiving elements, such as charge coupled devices (CCDs) or complementary metal oxide semiconductor (COMS) image sensors, are arranged. Furthermore, the image forming apparatus 1 according to the present embodiment is a multifunction peripheral (MFP) that has an image capturing function, an image forming function, a communication function, or the like, so that it can be used as a printer, facsimile machine, scanner, or copier.

Figure 2:
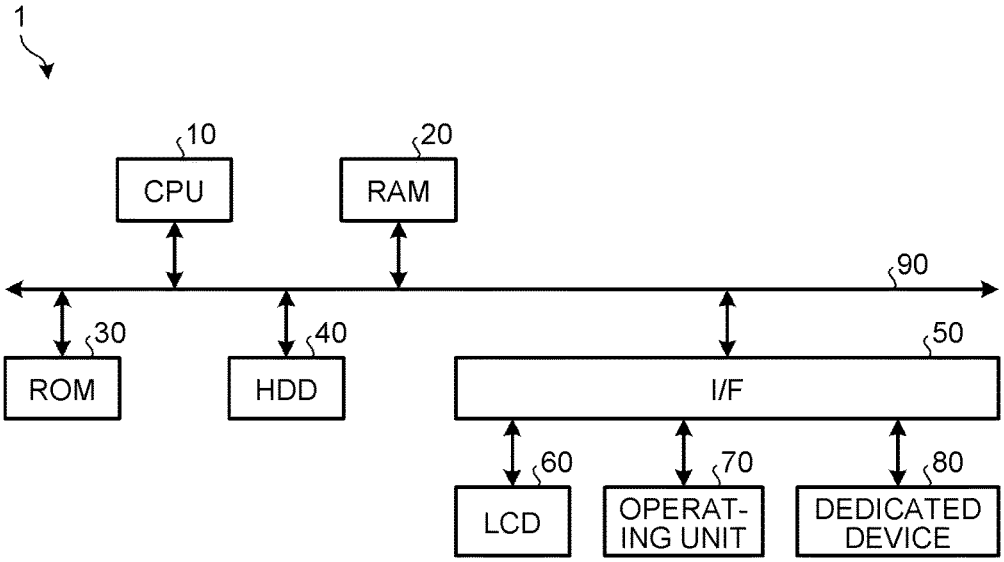
FIG. 2 is a block diagram that schematically illustrates a hardware configuration of the image forming apparatus according to the embodiment of the present invention.

Next, an explanation is given, with reference to FIG. 2, of a hardware configuration of the image forming apparatus 1 according to the present embodiment. FIG. 2 is a block diagram that schematically illustrates a hardware configuration of the image forming apparatus 1 according to the present embodiment. Furthermore, in addition to the hardware configuration illustrated in FIG. 2, the image forming apparatus 1 includes the engines for implementing a scanner, a printer, a folding operation, an additional folding operation, or the like.

As illustrated in FIG. 2, the image forming apparatus 1 according to the present embodiment has the same configuration as that of a typical server, personal computer (PC), or the like. Specifically, in the image forming apparatus 1 according to the present embodiment, a central processing unit (CPU) 10, a random access memory (RAM) 20, a read only memory (ROM) 30, a hard disk drive (HDD) 40, and an I/F 50 are connected to one another via a bus 90. Furthermore, the I/F 50 is connected to a liquid crystal display (LCD) 60, an operating unit 70, and a dedicated device 80.

The CPU 10 is a calculating unit, and it controls the overall operation of the image forming apparatus 1. The RAM 20 is a volatile storage medium that enables reading and writing of information at high speed, and it is used as a work area when the CPU 10 processes information. The ROM 30 is a non-volatile read-only storage medium, and it stores programs, such as firmware. The HDD 40 is a non-volatile storage medium that enables reading and writing of information, and it stores an operating system (OS), various control programs, application programs, or the like.

The I/F 50 connects to the bus 90, various types of hardware, networks, or the like, for a control. The LCD 60 is a visual user interface by which a user checks the state of the image forming apparatus 1. The operating unit 70 is a user interface, such as a keyboard or mouse, by which a user inputs information to the image forming apparatus 1.

The dedicated device 80 is the hardware for implementing dedicated functions with regard to the image forming unit 2, the folding processing unit 3, the additional-folding processing unit 4, and the scanner unit 5 and, with regard to the image forming unit 2, it is a plotter device that conducts an image formation output on a sheet surface. Furthermore, with regard to the folding processing unit 3, it is a conveying mechanism for conveying sheets or a folding processing mechanism for folding a conveyed sheet. The configuration of the folding processing mechanism included in the folding processing unit 3 is one of the aspects according to the present embodiment.

Furthermore, with regard to the additional-folding processing unit 4, it is an additional-folding processing mechanism for making an additional folding line of a sheet that is conveyed after the folding processing unit 3 performs a folding operation. Moreover, with regard to the scanner unit 5, it is a reading device that reads an image that is presented on a sheet surface.

With the above hardware configuration, the RAM 20 reads a program that is stored in a storage medium, such as the ROM 30, the HDD 40, or an undepicted optical disk, and the CPU 10 performs a calculation in accordance with the program that is loaded into the RAM 20, whereby a software control unit is configured. A functional block for implementing the functionality of the image forming apparatus 1 according to the present embodiment is configured by using a combination of the hardware and the software control unit that is configured as described above.

Figure 3:
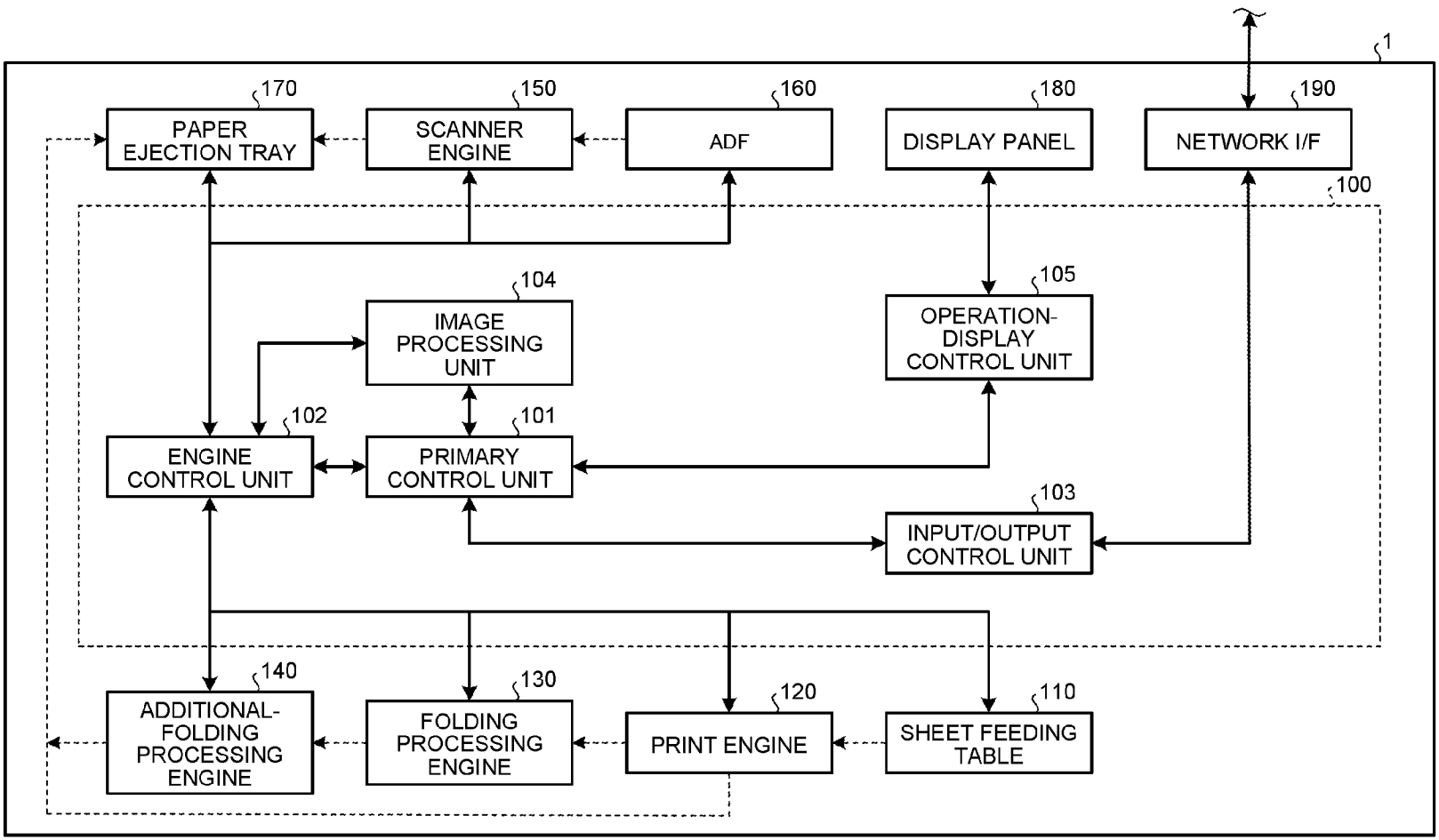
FIG. 3 is a block diagram that schematically illustrates the functional configuration of the image forming apparatus according to the embodiment of the present invention.

Next, an explanation is given, with reference to FIG. 3, of the functional configuration of the image forming apparatus 1 according to the present embodiment. FIG. 3 is a block diagram that schematically illustrates the functional configuration of the image forming apparatus 1 according to the present embodiment. Furthermore, in FIG. 3, electric connections are indicated by the arrows of solid lines, and the flow of a sheet or a bundle of documents is indicated by the arrows of dashed lines.

As illustrated in FIG. 3, the image forming apparatus 1 according to the present embodiment includes a controller 100, a sheet feeding table 110, a print engine 120, a folding processing engine 130, an additional-folding processing engine 140, a scanner engine 150, an automatic document feeder (ADF) 160, a paper ejection tray 170, a display panel 180, and a network I/F 190. The controller 100 further includes a main control unit 101, an engine control unit 102, an input/output control unit 103, an image processing unit 104, and an operation-display control unit 105.

The sheet feeding table 110 feeds a sheet to the print engine 120 that is an image forming section. The print engine 120 is an image forming section that is included in the image forming unit 2, and it conducts an image formation output on a sheet that is conveyed from the sheet feeding table 110 so as to draw an image. As a specific form of the print engine 120, it is possible to use an image forming mechanism that uses an ink jet system, an image forming mechanism that uses an electrophotographic system, or the like. The image-formed sheet on which an image has been drawn by the print engine 120 is conveyed to the folding processing unit 3 or is ejected to the paper ejection tray 170.

The folding processing engine 130 is included in the folding processing unit 3, and it performs a folding operation on the image-formed sheet that is conveyed from the image forming unit 2. The folding-processed sheet, on which a folding operation has been performed by the folding processing engine 130, is conveyed to the additional-folding processing unit 4. The additional-folding processing engine 140 is included in the additional-folding processing unit 4, and it performs an additional folding operation on a folding line that is formed on the folding-processed sheet that is conveyed from the folding processing engine 130. The additional-folding processed sheet, on which an additional folding operation has been performed by the additional-folding processing engine 140, is ejected to the paper ejection tray 170 or is conveyed to an undepicted post-processing unit that conducts post-processing, such as stapling, punching, or bookbinding processing.

The ADF 160 is included in the scanner unit 5, and it automatically feeds an original document to the scanner engine 150 that is an original-document reading section. The scanner engine 150 is included in the scanner unit 5, and it is an original-document reading section that includes a photoelectric conversion element that converts optical information into electric signals; thus, it optically scans and reads an original document that is automatically fed by the ADF 160 or an original document that is placed on an undepicted platen glass to generate image information. After an original document is automatically fed by the ADF 160 and is read by the scanner engine 150, it is ejected to the paper ejection tray 170.

The display panel 180 is an output interface that visually displays the state of the image forming apparatus 1, and it is also an input interface that is used as a touch panel for a user to directly operate the image forming apparatus 1 or for inputting information to the image forming apparatus 1. Specifically, the display panel 180 has a function to display an image for which a user's operation is received. The display panel 180 is implemented by using the LCD 60 and the operating unit 70 that are illustrated in FIG. 2.

The network I/F 190 is an interface by which the image forming apparatus 1 communicates with other devices, such as an administrator-dedicated terminal, via a network, and Ethernet (registered trademark) or universal serial bus (USB) interface, Bluetooth (registered trademark), Wireless Fidelity (Wi-Fi), FeliCa (registered trademark) interface, or the like, are used. The network I/F 190 is implemented by using the I/F 50 that is illustrated in FIG. 2.

The controller 100 is configured by using a combination of software and hardware. Specifically, control programs, such as firmware, stored in a non-volatile storage medium, such as the ROM 30 or the HDD 40, are loaded into the RAM 20, and the controller 100 is configured by using a software control unit that is configured when the CPU 10 performs calculations in accordance with the programs and hardware, such as an integrated circuit. The controller 100 serves as a control unit that performs overall control of the image forming apparatus 1.

The main control unit 101 performs a function to control each unit included in the controller 100 and gives a command to each unit of the controller 100. Furthermore, the main control unit 101 controls the input/output control unit 103 so as to access other devices via the network I/F 190 and a network. The engine control unit 102 controls or drives driving units, such as the print engine 120, the folding processing engine 130, the additional-folding processing engine 140, or the scanner engine 150. The input/output control unit 103 inputs, to the main control unit 101, a signal or command that is input via the network I/F 190 and a network.

Under control of the main control unit 101, the image processing unit 104 generates drawing information on the basis of document data or image data that is included in an input print job. The drawing information is data, such as CMYK bitmap data, and it is the information for drawing an image that is to be formed during an image forming operation by the print engine 120 that is an image forming section. Furthermore, the image processing unit 104 processes captured-image data that is input from the scanner engine 150 and generates image data. The image data is the information that, as a result of a scanner operation, is stored in the image forming apparatus 1 or is transmitted to other devices via the network I/F 190 and a network. The operation-display control unit 105 displays information on the display panel 180 or notifies the main control unit 101 of the information that is input via the display panel 180.

Next, an explanation is given, with reference to FIGS. 4 to 9, of an operation example when the folding processing unit 3 according to the present embodiment performs a folding operation. FIGS. 4 to 9 are cross-sectional views that illustrate, in a main-scanning direction, the folding processing unit 3 that performs a folding operation in the image forming apparatus 1 according to the present embodiment. Furthermore, an operation of each operating unit that is described below is performed under control of the main control unit 101 and the engine control unit 102.

Figure 4:
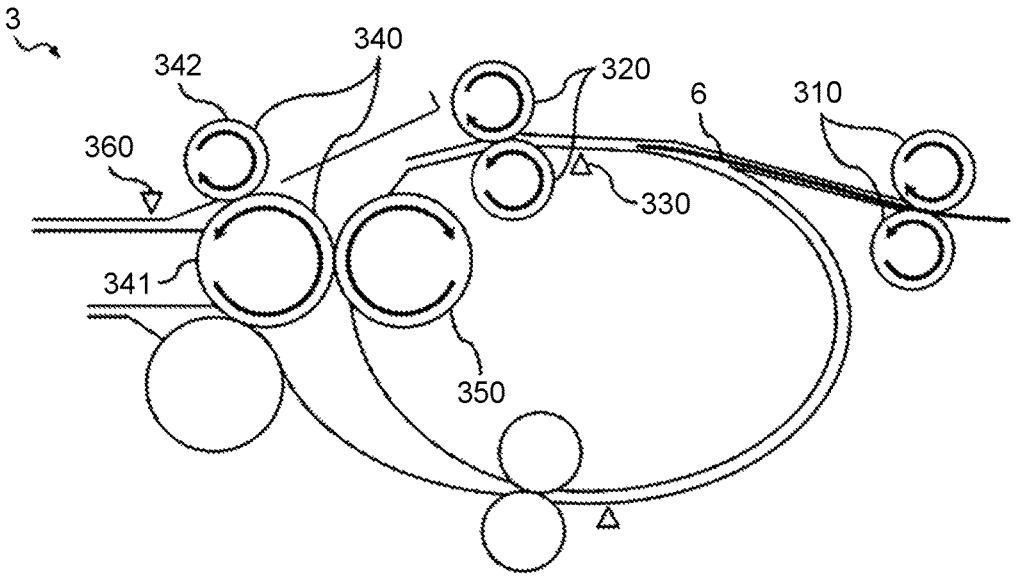
FIG. 4 is a cross-sectional view that illustrates, in a main-scanning direction, a folding processing unit that performs a folding operation in the image forming apparatus according to the embodiment of the present invention.

In the folding processing unit 3 according to the present embodiment, when a folding processing operation is performed, an image-formed sheet 6 that is conveyed from the image forming unit 2 is firstly delivered by a pair of entry rollers 310 toward a pair of conveyance rollers 320, as illustrated in FIG. 4.

Figure 5:
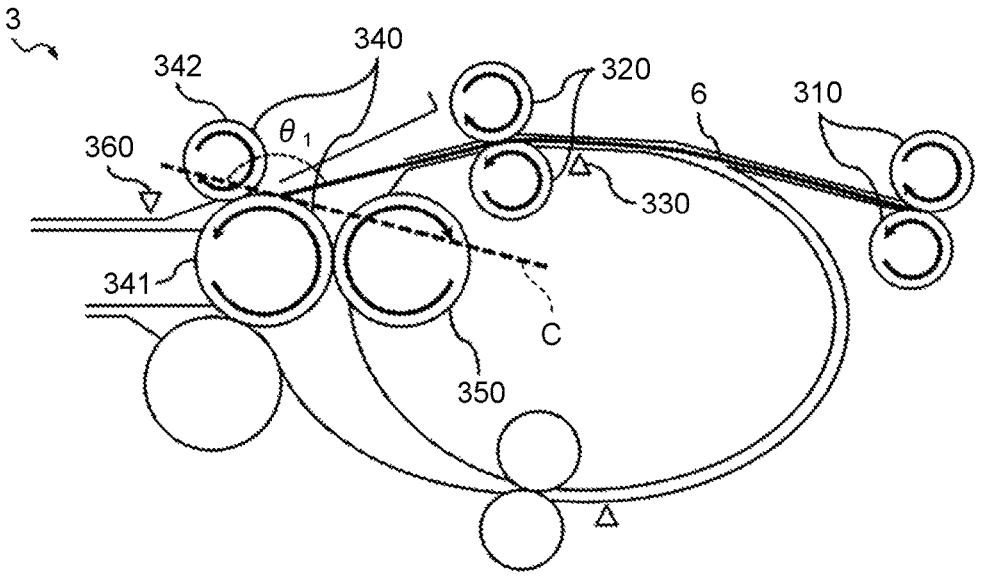
FIG. 5 is a cross-sectional view that illustrates, in a main-scanning direction, the folding processing unit that performs a folding operation in the image forming apparatus according to the embodiment of the present invention.
Figure 6:
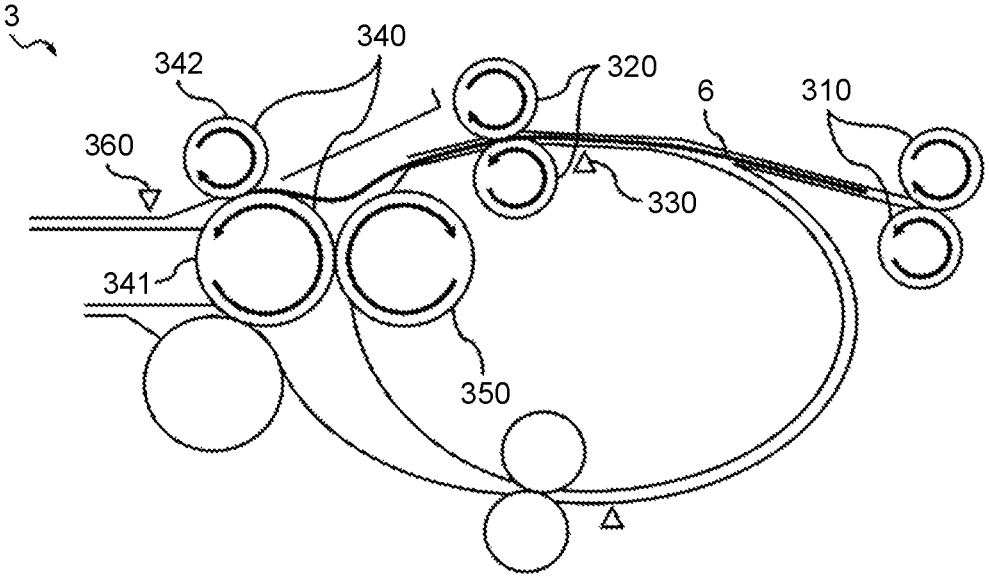
FIG. 6 is a cross-sectional view that illustrates, in a main-scanning direction, the folding processing unit that performs a folding operation in the image forming apparatus according to the embodiment of the present invention.

Then, in the folding processing unit 3 according to the present embodiment, as illustrated in FIGS. 5 and 6, when a first end-detection sensor 330 detects an end of the sheet 6 that is conveyed by the pair of entry rollers 310, the pair of conveyance rollers 320 is rotated so that the conveyed sheet 6 is delivered toward a pair of forward-reverse rotary rollers 340. Specifically, according to the present embodiment, the pair of conveyance rollers 320 serves as a conveying unit. In the present embodiment, an explanation is given of a case where the pair of conveyance rollers 320 is the conveying unit that conveys the sheet 6 toward the pair of forward-reverse rotary rollers 340; however, it may be a conveyance belt, or the like, if it is configured to convey the sheet 6 toward the pair of forward-reverse rotary rollers 340.

Figure 10:
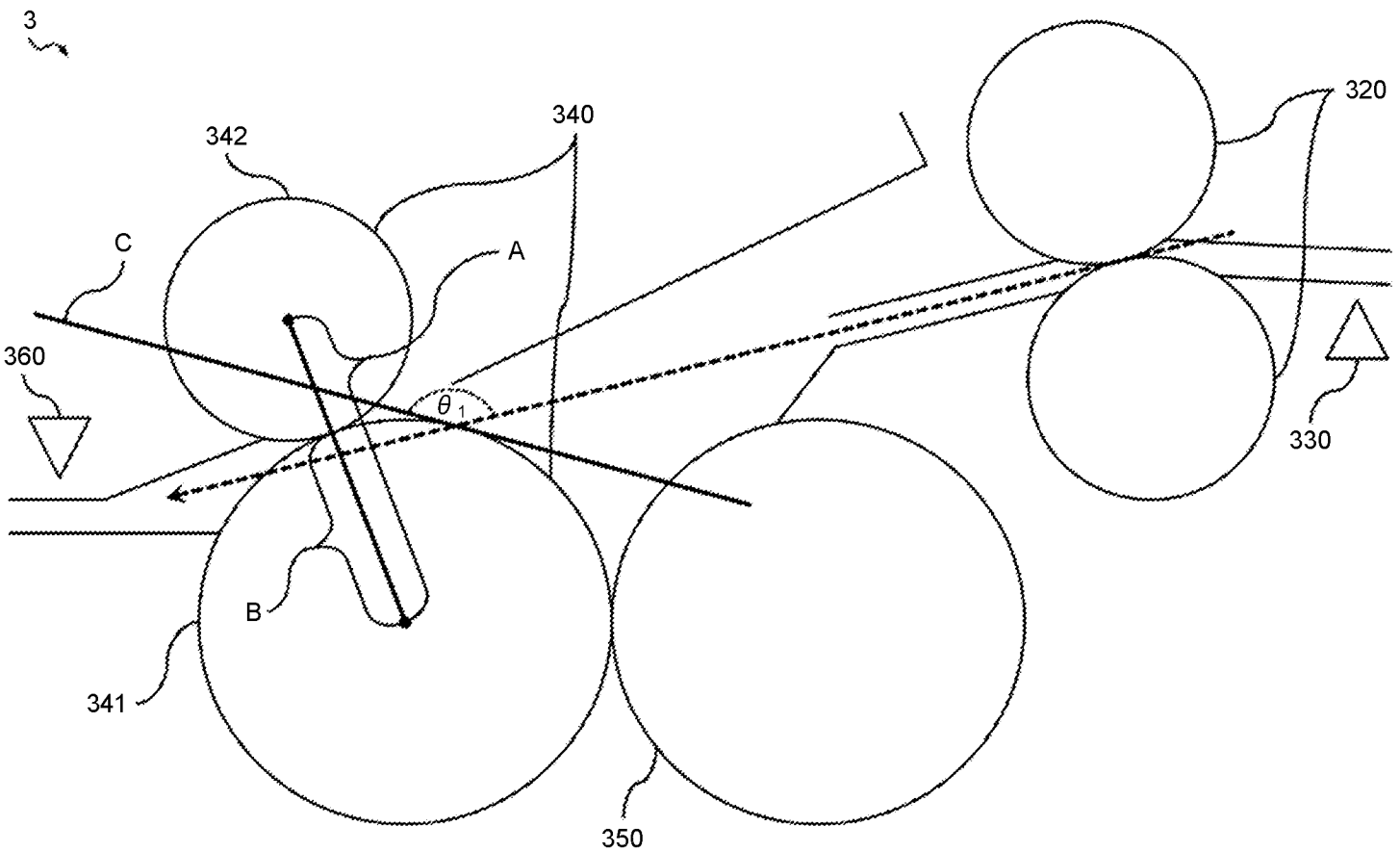
FIG. 10 is a cross-sectional view that illustrates, in a main-scanning direction, a pair of conveyance rollers and a pair of forward-reverse rotary rollers of the folding processing unit in the image forming apparatus according to the embodiment of the present invention.

Here, an explanation is given, with reference to FIG. 10, of the positional relationship between the pair of conveyance rollers 320 and the pair of forward-reverse rotary rollers 340. FIG. 10 is a cross-sectional view that illustrates, in a main-scanning direction, the pair of conveyance rollers 320 and the pair of forward-reverse rotary rollers 340 of the folding processing unit 3 in the image forming apparatus 1 according to the present embodiment. Furthermore, in FIG. 10, the direction in which the pair of conveyance rollers 320 conveys the sheet 6 is indicated by the arrow of a dotted line.

As illustrated in FIG. 10, in the folding processing unit 3 according to the present embodiment, the pair of forward-reverse rotary rollers 340 includes a first forward-reverse rotary roller 341 that rotates around a rotation axis in a direction that is perpendicular to a conveying direction of the sheet 6 and that is parallel to a sheet surface of the sheet 6, i.e., in a main-scanning direction, and includes a second forward-reverse rotary roller 342 that rotates in the opposite direction of the first forward-reverse rotary roller 341. Furthermore, as illustrated in FIG. 10, in the folding processing unit 3 according to the present embodiment, the pair of conveyance rollers 320, the first forward-reverse rotary roller 341, and the second forward-reverse rotary roller 342 are arranged such that, out of a line segment A that connects between the rotation axes of the first forward-reverse rotary roller 341 and the second forward-reverse rotary roller 342, a line segment B that belongs to the first forward-reverse rotary roller 341 abuts or intersects with a conveying direction by the pair of conveyance rollers 320.

With such a configuration, as illustrated in FIG. 10, in the folding processing unit 3 according to the present embodiment, out of a tangent line C to the peripheral surface of the first forward-reverse rotary roller 341 at the intersection point between the peripheral surface of the first forward-reverse rotary roller 341 and the conveying direction of the sheet 6, a straight line toward the second forward-reverse rotary roller 342 and the conveying direction of the sheet 6 form an angle $\theta_1$ that is a right angle or an obtuse angle. Such a configuration of the folding processing unit 3 according to the present embodiment is one of the aspects. Specifically, according to the present embodiment, the pair of forward-reverse rotary rollers 340 serves as a bend forming unit, and the first forward-reverse rotary roller 341 and the second forward-reverse rotary roller 342 serve as a first bend forming roller and a second bend forming roller, respectively.

Therefore, as illustrated in FIG. 5, in the folding processing unit 3 according to the present embodiment, when the sheet 6 is conveyed by the pair of conveyance rollers 320 toward the pair of forward-reverse rotary rollers 340, an conveying-direction end of the sheet 6 is first brought into contact with the first forward-reverse rotary roller, and then the tangent line C at the point where the sheet 6 is in contact with the first forward-reverse rotary roller and the sheet surface of the sheet 6 form the angle $\theta_1$ that is a right angle or an obtuse angle. Furthermore, as illustrated in FIG. 6, in the folding processing unit 3 according to the present embodiment, after the conveying-direction end of the sheet 6 is brought into contact with the first forward-reverse rotary roller, part of the force in the conveying direction is distributed over the sheet surface of the sheet 6 in accordance with the conveyance, whereby it is bent toward a folding processing roller 350 at a predetermined position.

Specifically, here, if the vector of the sheet 6 in the conveying direction when the conveying-direction end thereof is brought into contact with the first forward-reverse rotary roller is decomposed into vectors in a tangential direction at the contact point between the conveyance path of the sheet 6 and the surface of the first forward-reverse rotary roller 341 and in a direction perpendicular to the tangential direction, the vector in the tangential direction includes a component in a direction from the above-described contact point toward the second forward-reverse rotary roller. Therefore, when the conveying-direction end of the sheet 6 is brought into contact with the first forward-reverse rotary roller, the sheet 6 is bent toward the folding processing roller 350.

Thus, it is possible to ensure that, when the sheet 6 is to be bent, the folding processing unit 3 according to the present embodiment bends the sheet 6 in an intended direction without the need for, for example, a dedicated conveyance path for preparing for a folding operation that is performed on the sheet 6 or a stopper for adjusting a folding position or forming a bend when the end of the conveyed sheet 6 is brought into contact.

Figure 11:
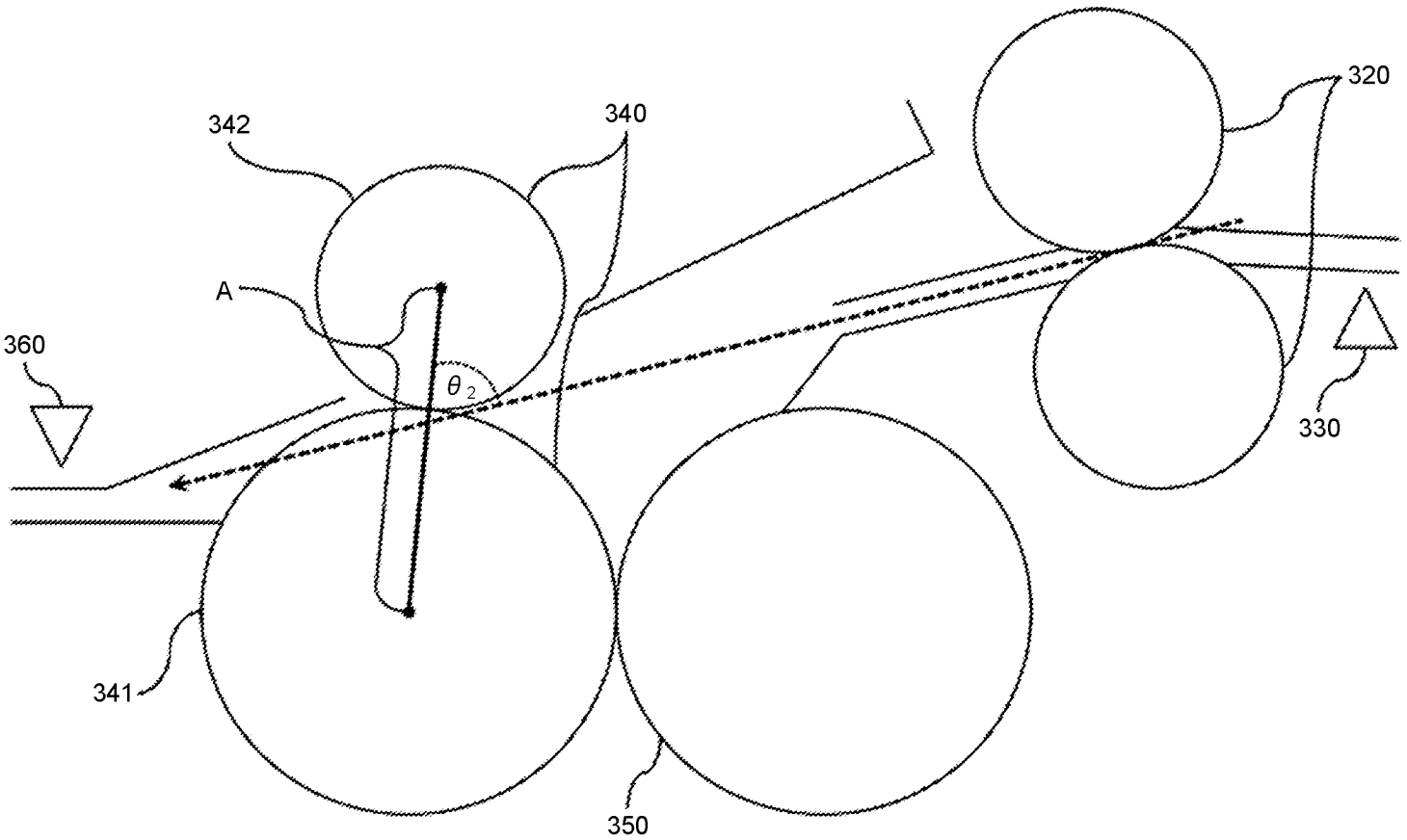
FIG. 11 is a cross-sectional view that illustrates, in a main-scanning direction, the pair of conveyance rollers and the pair of forward-reverse rotary rollers of the folding processing unit in the image forming apparatus according to the embodiment of the present invention.

Furthermore, here, as illustrated in FIG. 11, in the folding processing unit 3 according to the present embodiment, the pair of conveyance rollers 320, the first forward-reverse rotary roller 341, and the second forward-reverse rotary roller 342 are arranged such that, out of the line segment A that connects the rotation axes of the first forward-reverse rotary roller 341 and the second forward-reverse rotary roller 342, a line segment toward the second forward-reverse rotary roller 342 and a conveying direction by the pair of conveyance rollers 320 form an angle $\theta_2$ that is a right angle or an acute angle, whereby it is possible to further ensure that the sheet 6 is bent in an intended direction.

Figure 12:
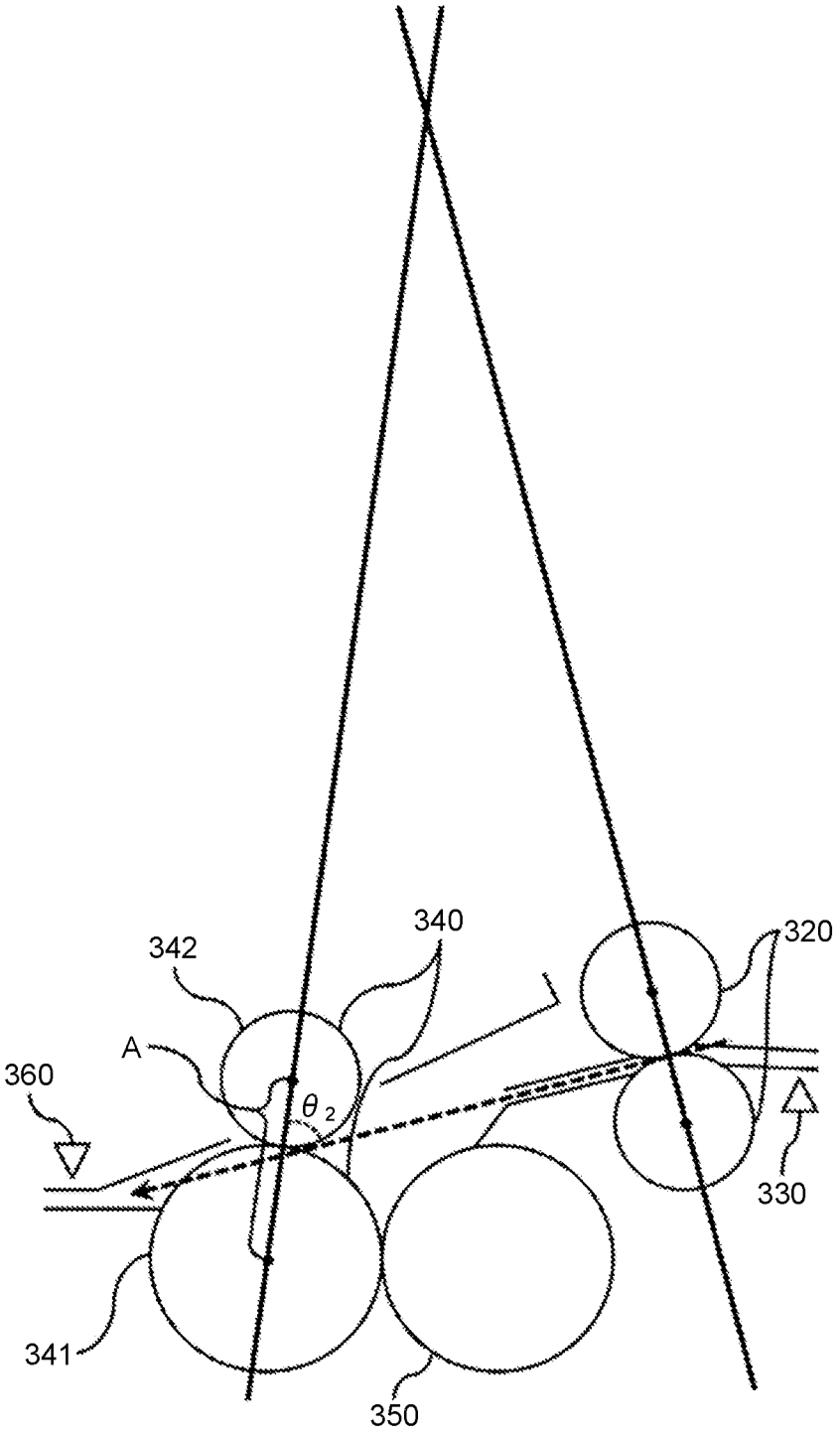
FIG. 12 is a cross-sectional view that illustrates, in a main-scanning direction, the pair of conveyance rollers and the pair of forward-reverse rotary rollers of the folding processing unit in the image forming apparatus according to the embodiment of the present invention.

With the above configuration, as illustrated in FIG. 12, in the folding processing unit 3 according to the present embodiment, an inverted "V" shape is formed between a straight line that passes through the rotation axis of each roller of the pair of forward-reverse rotary rollers 340 and a straight line that passes through the rotation axis of each roller of the pair of conveyance rollers 320, and they intersect with each other in an upper section of the folding processing unit 3 in FIG. 12.

Figure 13:
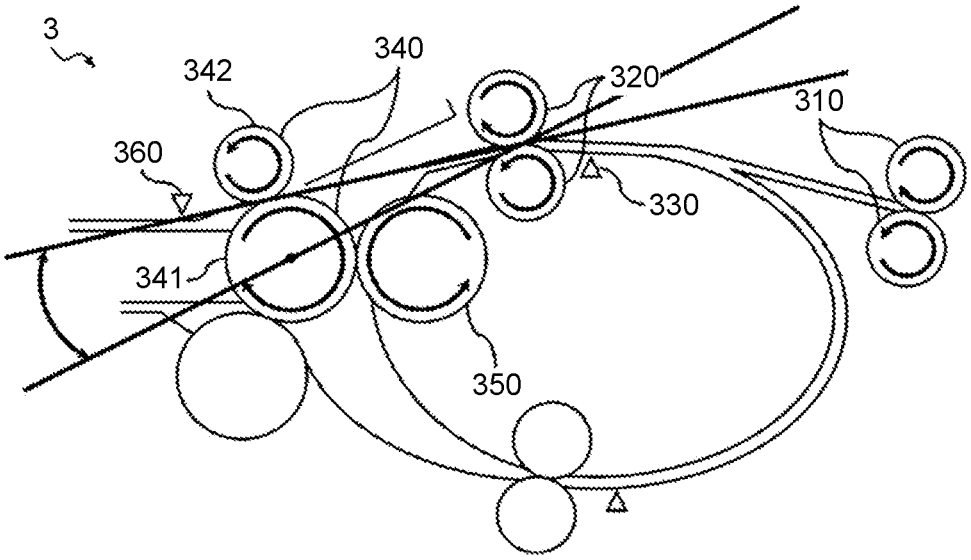
FIG. 13 is a cross-sectional view that illustrates, in a main-scanning direction, the pair of conveyance rollers and the pair of forward-reverse rotary rollers of the folding processing unit in the image forming apparatus according to the embodiment of the present invention.

Furthermore, as illustrated in FIG. 13, if the folding processing unit 3 according to the present embodiment has a configuration such that the conveying direction of the sheet 6 by the pair of conveyance rollers 320 is located between a straight line that passes through the nip section of the pair of conveyance rollers 320 and the rotation axis of the first forward-reverse rotary roller 341 and a straight line that passes through the nip section of the pair of conveyance rollers 320 and the nip section between the first forward-reverse rotary roller 341 and the second forward-reverse rotary roller 342, it is possible to ensure that the sheet 6 is bent in an intended direction.

Figure 7:
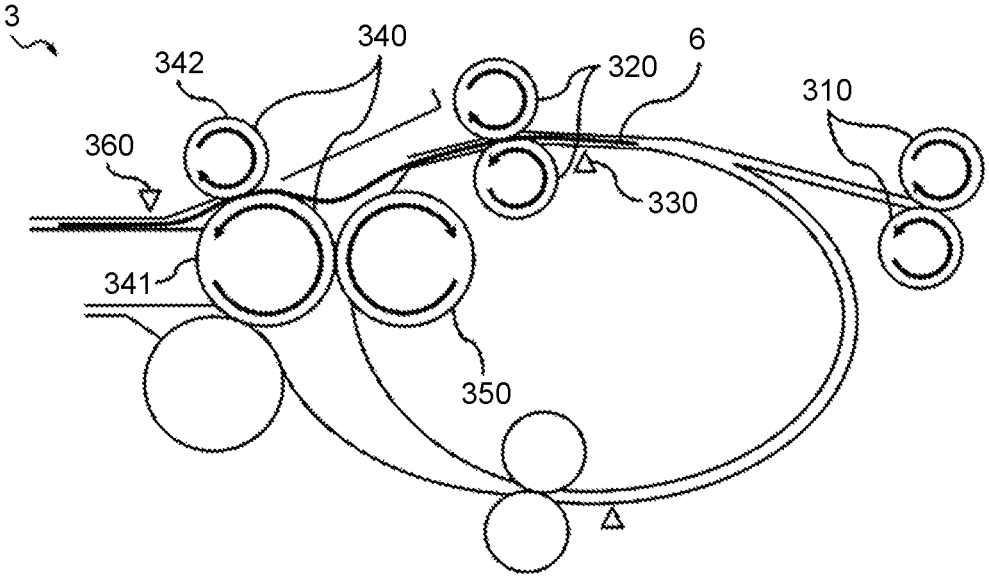
FIG. 7 is a cross-sectional view that illustrates, in a main-scanning direction, the folding processing unit that performs a folding operation in the image forming apparatus according to the embodiment of the present invention.

In the folding processing unit 3 according to the present embodiment, after a bend is formed on the sheet 6 as described above, the sheet 6 with a bend formed thereon is further conveyed by the pair of conveyance rollers 320 and the pair of forward-reverse rotary rollers 340 while the state is maintained, as illustrated in FIG. 7, and after it is conveyed for a predetermined distance, the rotation direction of the pair of forward-reverse rotary rollers 340 is reversed. An explanation is given of a case where the folding processing unit 3 according to the present embodiment has a configuration such that the pair of conveyance rollers 320 and the pair of forward-reverse rotary rollers 340 convey the sheet 6 with a bend formed thereon while maintaining the state; however, a configuration may be such that a conveying speed of the pair of forward-reverse rotary rollers 340 that is located on the downstream side in a conveying direction is lower than a conveying speed of the pair of conveyance rollers 320 that is located on the upstream side in a conveying direction so that the sheet 6 with a bend formed thereon is conveyed while a bend is further formed.

Here, in the folding processing unit 3 according to the present embodiment, the above-described predetermined distance is measured by measuring the distance for which the first forward-reverse rotary roller 341 or the second forward-reverse rotary roller 342 rotates after a second end-detection sensor 360 detects the end of the sheet 6 that is conveyed by the pair of conveyance rollers 320 and the pair of forward-reverse rotary rollers 340. The predetermined distance is determined on the basis of, for example, the length of the sheet 6 in a conveying direction or the type of folding, and it is previously stored in a non-volatile storage medium, such as the ROM 30. Furthermore, the folding processing unit 3 according to the present embodiment may have a configuration such that the sheet 6 is continuously conveyed after the second end-detection sensor 360 detects the conveying-direction end of the conveyed sheet 6 until the degree of protrusion of the end of the sheet 6 from the nip position between the first forward-reverse rotary roller 341 and the second forward-reverse rotary roller 342 becomes an arbitrary degree of protrusion $\Delta 1$. Furthermore, the degree of protrusion $\Delta 1$ is determined on the basis of the length of a sheet and the type of folding, and a configuration may be such that it is determined on the basis of the distance for which the second forward-reverse rotary roller 342 rotates.

Figure 8:
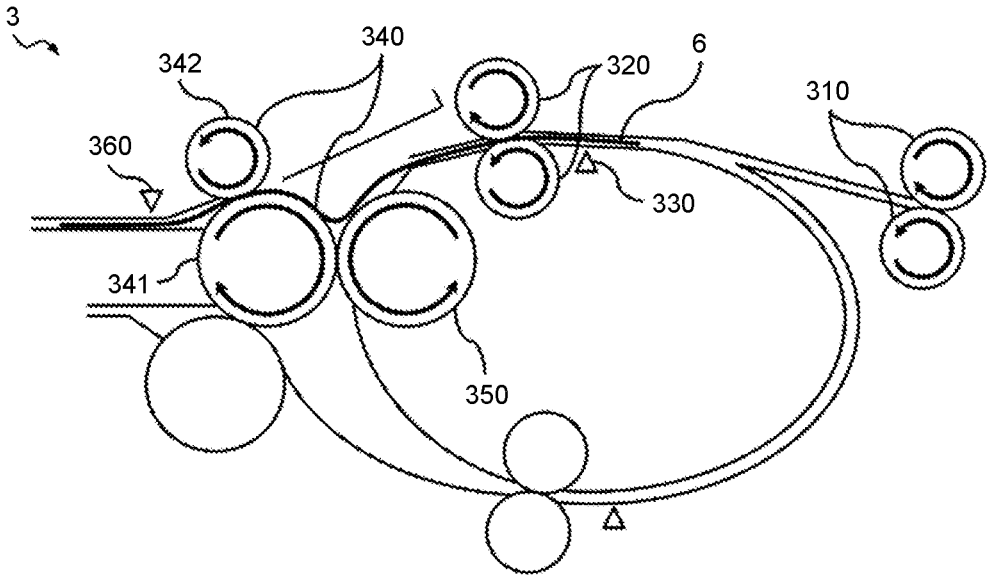
FIG. 8 is a cross-sectional view that illustrates, in a main-scanning direction, the folding processing unit that performs a folding operation in the image forming apparatus according to the embodiment of the present invention.

In the folding processing unit 3 according to the present embodiment, after the rotation direction of the pair of forward-reverse rotary rollers 340 is reversed, the sheet 6 is conveyed by the pair of conveyance rollers 320 and the pair of forward-reverse rotary rollers 340 as illustrated in FIG. 8 so that the bend formed on the sheet 6 is pushed into the nip section between the first forward-reverse rotary roller 341 and the folding processing roller 350 without changing the position of the bend.

Figure 9:
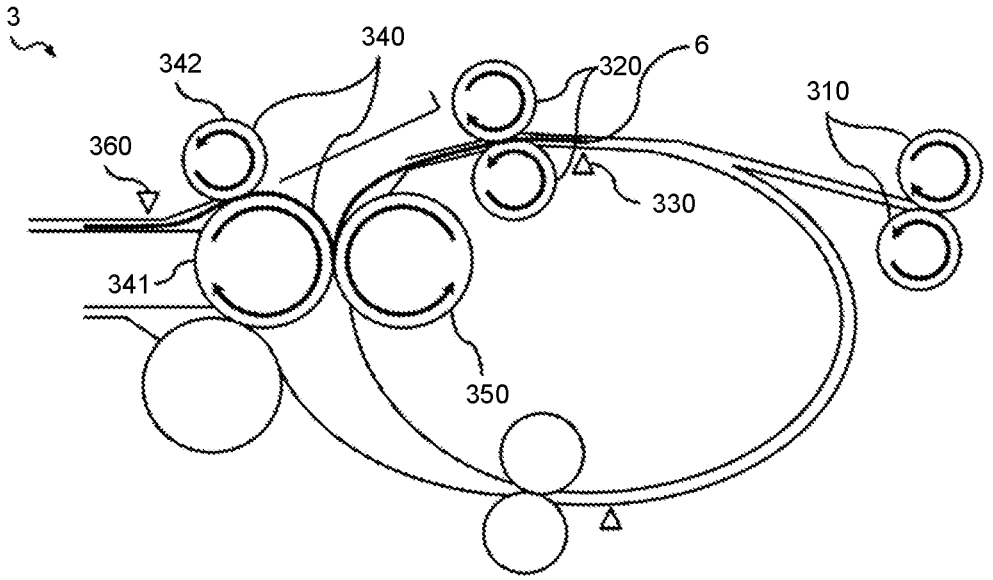
FIG. 9 is a cross-sectional view that illustrates, in a main-scanning direction, the folding processing unit that performs a folding operation in the image forming apparatus according to the embodiment of the present invention.

Then, in the folding processing unit 3 according to the present embodiment, as illustrated in FIG. 9, while the folding processing roller 350 is pressed against the first forward-reverse rotary roller 341, it is rotated in the direction opposite to the rotation direction of the first forward-reverse rotary roller 341, whereby the pushed bend is caught and nipped so that a folding line is formed at a predetermined position of the sheet 6. Thus, the folding processing unit 3 according to the present embodiment is configured to fold the sheet 6 by using a nipping and reversing method. Then, the folding processing unit 3 according to the present embodiment completes the folding processing operation. That is, according to the present embodiment, the folding processing roller 350 serves as a folding line forming unit.

Figure 14:
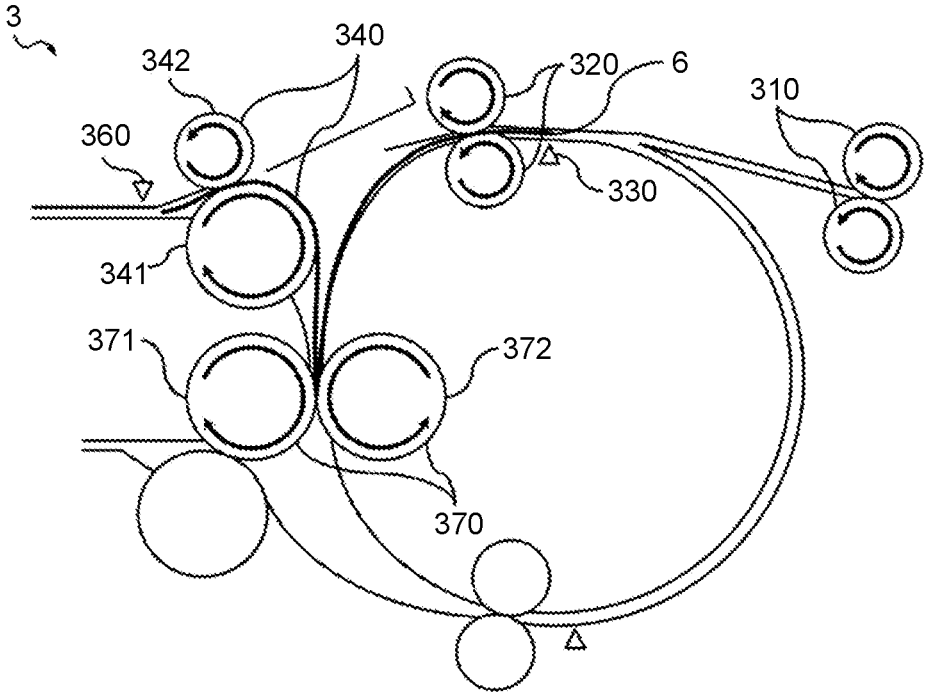
FIG. 14 is a cross-sectional view that illustrates, in a main-scanning direction, the folding processing unit that performs a folding operation in the image forming apparatus according to the embodiment of the present invention.

An explanation is given of a case where the folding processing unit 3 according to the present embodiment is configured to form a folding line at a predetermined position of the sheet 6 by using the folding processing roller 350 and the first forward-reverse rotary roller 341 as illustrated in FIG. 9; however, a configuration may be such that, as illustrated in FIG. 14, a folding line is formed at a predetermined position of the sheet 6 by using a pair of folding processing rollers 370 that includes a first folding processing roller 371 that rotates around the rotation axis in a direction that is perpendicular to a conveying direction of the sheet 6 and that is parallel to a sheet surface of the sheet 6, i.e., in a main-scanning direction, and includes a second folding processing roller 372 that rotates in the opposite direction of the first folding processing roller 371. With such a configuration, the pair of folding processing rollers 370 serves as a folding line forming unit, and the rollers included in the pair of folding processing rollers 370 serve as a first folding line forming roller and a second folding line forming roller, respectively. Furthermore, in the present embodiment, an explanation is given of a case where a folding line forming unit that forms a folding line is the folding processing roller 350 or the pair of folding processing rollers 370; however, it may not be a roller or a pair of rollers if it is configured to form a folding line by pressing a formed bend on a sheet surface. Furthermore, in the folding processing unit 3 according to the present embodiment, a stopping member may be provided on a conveyance path of the folding processing roller 350.

As described above, during the operations that are illustrated in FIGS. 4 to 9, the folding processing unit 3 according to the present embodiment is configured to form a folding line at a predetermined position of the sheet 6.

Figure 15:
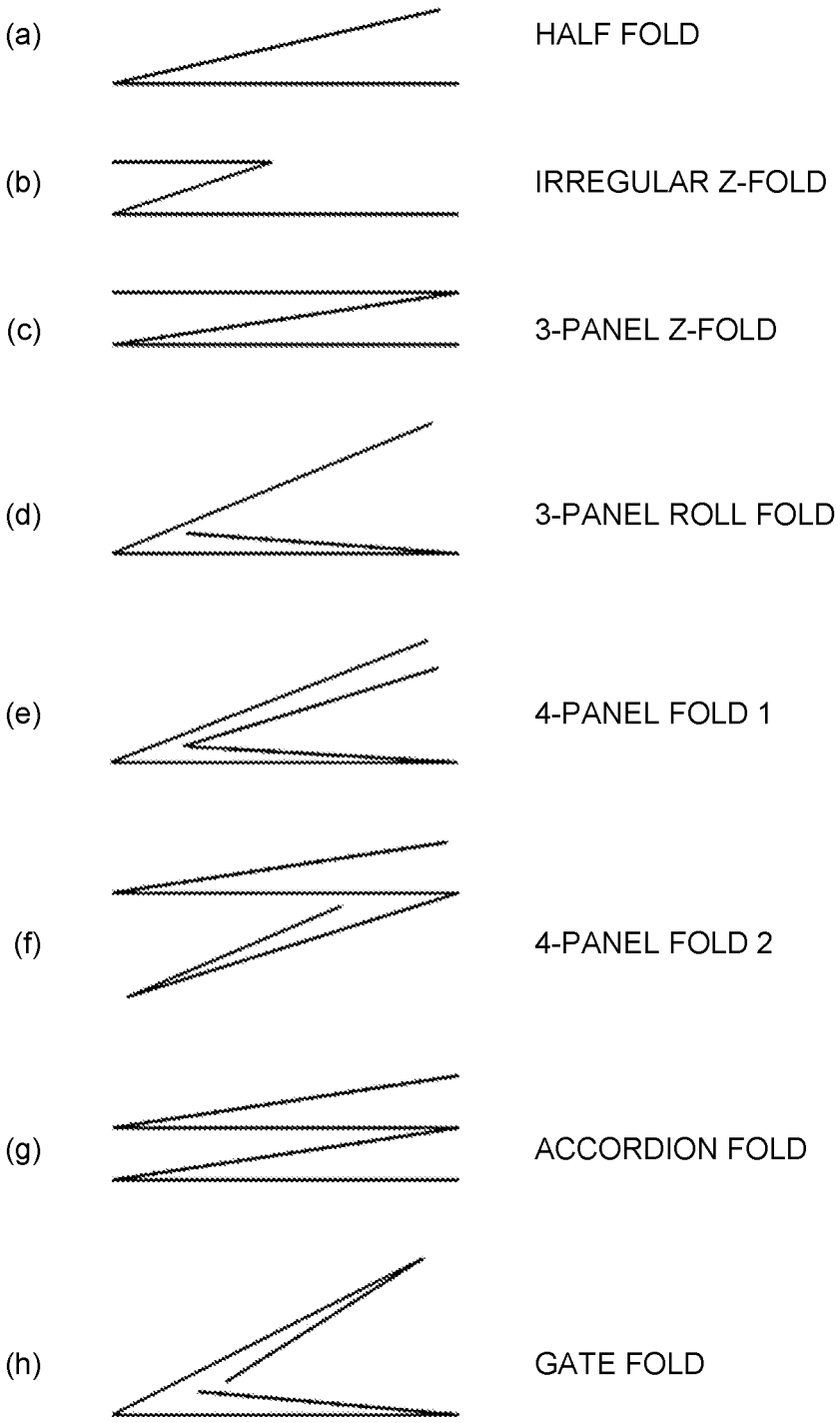
FIG. 15 is a diagram illustrating examples (a) to (h) of the form of a folding-processed sheet on which a folding operation has been performed by the folding processing unit according to the embodiment of the present invention.

Examples of the form of the sheet 6 on which a folding operation has been performed as described above are illustrated in FIG. 15. FIG. 15 is diagram that illustrate examples (a) to (h) of the form of the folding-processed sheet 6 on which a folding operation has been performed by the folding processing unit 3 according to the present embodiment.

Furthermore, in the present embodiment, an explanation is given of a configuration in which the image forming unit 2, the folding processing unit 3, the additional-folding processing unit 4, and the scanner unit 5 are included in the image forming apparatus 1; however, each unit may be configured as a different independent unit, and these units may be connected to one another so as to configure an image forming system.

Figure 16:
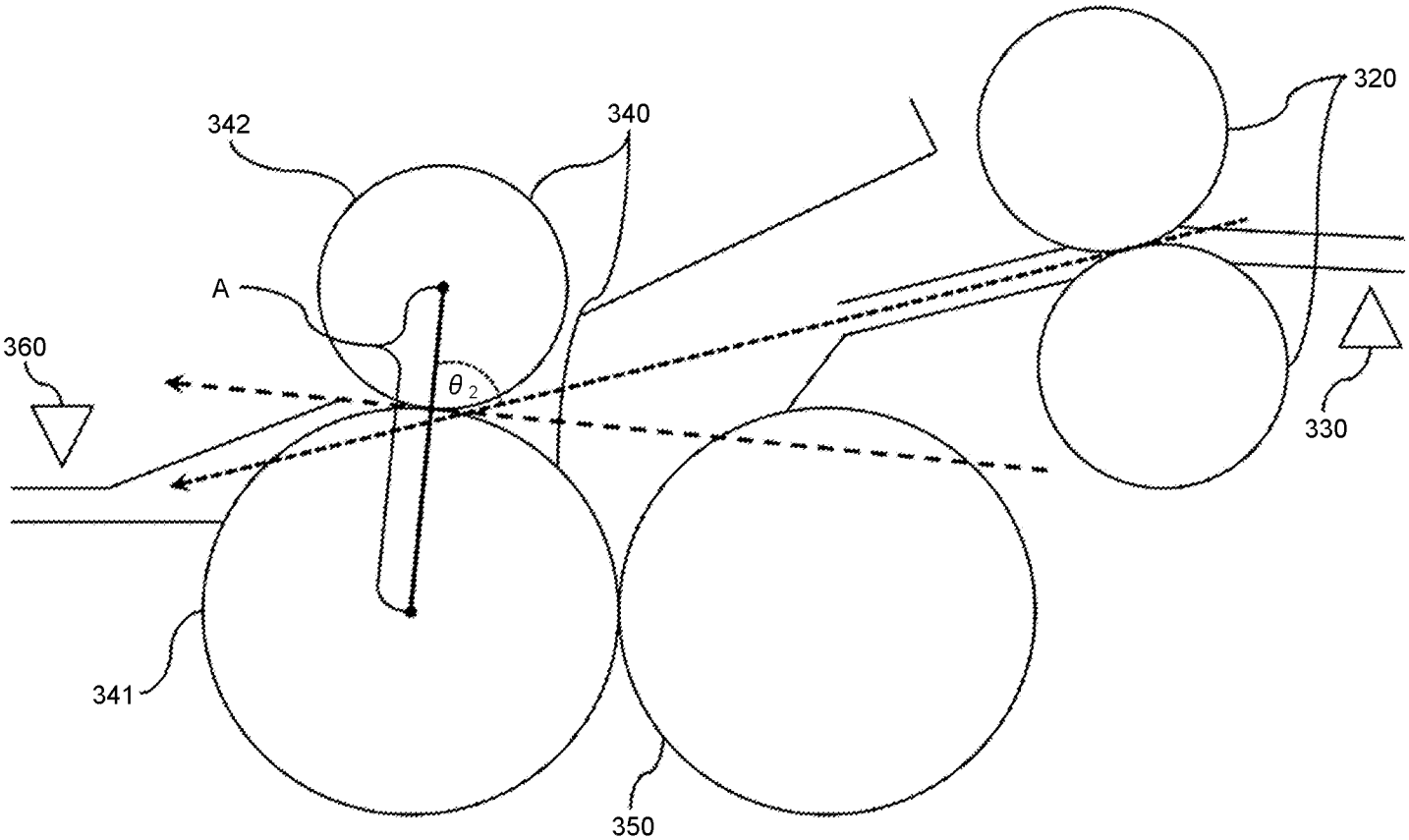
FIG. 16 is a cross-sectional view that illustrates, in a main-scanning direction, the pair of conveyance rollers and the pair of forward-reverse rotary rollers of the folding processing unit in the image forming apparatus according to the embodiment of the present invention.

Furthermore, as illustrated in FIG. 16, the folding processing unit 3 according to the present embodiment may have a configuration such that a conveying direction by the pair of conveyance rollers 320 intersects with a conveying direction by the pair of forward-reverse rotary rollers 340 and, in the interval between the pair of conveyance rollers 320 and the pair of forward-reverse rotary rollers, the conveying direction by the pair of forward-reverse rotary rollers 340 is located closer to a nip section between the first forward-reverse rotary roller 341 and the folding processing roller 350 compared to the conveying direction by the pair of conveyance rollers 320. As the folding processing unit 3 according to the present embodiment has the above configuration, it is possible to ensure that the sheet 6 is bent at a target position toward the first forward-reverse rotary roller 341. Thus, as the folding processing unit 3 according to the present embodiment has the above configuration, it is possible to ensure that the sheet 6 is bent in an intended direction, and it is possible to improve the accuracy of the position where a bend is formed.

According to the present invention, it is possible to provide a folding processing apparatus that performs a folding operation on sheets with a small-sized and simple configuration at low costs.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus that forms a folding line on a conveyed sheet, the sheet processing apparatus comprising:

a bend forming unit, configured to use a first bend forming roller and a second bend forming roller, that rotate around rotation axes in a direction perpendicular to a conveying direction of the sheet and parallel to a surface of the sheet, to nip and hold both surfaces of the conveyed sheet and form a bend on the sheet by making a conveying speed of a held portion lower than a conveying speed of the sheet on an upstream side;

a conveying unit to convey the sheet toward the bend forming unit such that, when a vector in a conveying direction of the sheet conveyed to the bend forming unit is decomposed into vectors in a direction of a tangent line at a contact point between a conveyance path of the sheet and a surface of the first bend forming roller and in a direction perpendicular to the tangent line, the vector in the direction of the tangent line includes a component in a direction from the contact point toward the second bend forming roller; and a folding line forming unit, located on an opposite side of the second bend forming roller with respect to the contact point, to press the bend formed on the conveyed sheet from the surface of the sheet so as to form a folding line on the sheet.

2. The sheet processing apparatus according to claim 1, wherein the conveying unit and the bend forming unit are arranged such that a conveying direction of the sheet by the conveying unit intersects with a conveying direction of the sheet by the bend forming unit and, in an interval between the conveying unit and the bend forming unit, the conveying direction of the sheet by the bend forming unit is located relatively closer to the bend forming unit than to the conveying direction of the sheet by the conveying unit or such that the conveying direction of the sheet by the conveying unit intersects with the first bend forming roller.

3. The sheet processing apparatus according to claim 1, wherein the conveying unit is configured to convey the sheet toward the bend forming unit such that, out of a straight line passing through the rotation axes of the first bend forming roller and the second bend forming roller and parallel to a conveying direction of the sheet, a straight line toward the second bend forming roller and the conveyance path form an acute angle.

4. The sheet processing apparatus according to claim 1, wherein the bend forming unit is configured to nip both surfaces of the sheet conveyed by the conveying unit while rotating the first bend forming roller and the second bend forming roller on a downstream side of the conveying unit in the conveying direction so as to convey the sheet for a distance while maintaining a position of the formed bend and, after conveying the sheet for the distance, to reverse rotation directions of the first bend forming roller and the second bend forming roller to move the formed bend toward the folding line forming unit.

5. The sheet processing apparatus according to claim 1, wherein the folding line forming unit is configured to form a folding line on the sheet by nipping the bend moved by the bend forming unit on both surfaces of the sheet while rotating a first folding line forming roller and a second folding line forming roller that rotate around rotation axes in a direction perpendicular to a conveying direction of the sheet and parallel to a surface of the sheet.

6. The sheet processing apparatus according to claim 1, wherein the first bend forming roller is one of the first folding line forming roller and the second folding line forming roller.

7. An image forming system comprising:

an image forming apparatus to conduct an image formation output on the sheet; and the sheet processing apparatus according to claim 1 to form a folding line on the sheet on which the image forming apparatus forms an image.

8. The sheet processing apparatus as recited in claim 1, wherein the bend forming unit is further configured to form the bend on the sheet without using a stopper in the conveyance path between the first pair of rollers and the second pair of rollers.

9. A sheet processing method for forming a folding line on a conveyed sheet, the sheet processing method comprising:

nipping and holding both surfaces of the conveyed sheet by using a first bend forming roller and a second bend forming roller that rotate around rotation axes that is in a direction that is perpendicular to a conveying direction of the sheet and parallel to a surface of the sheet and forming a bend on the sheet by making a conveying speed of a held portion relatively lower than a conveying speed of the sheet on an upstream side;

conveying the sheet toward the bend forming unit such that a conveying direction of the sheet conveyed to a bend forming unit that forms the bend passes through a line segment from the rotation axis of the first bend forming roller to a position on a surface of the first bend forming roller; and forming a folding line on the sheet by pressing the bend formed on the conveyed sheet from a surface of the sheet in a position on an opposite side of the second bend forming roller with respect to a position where the sheet is in contact with the first bend forming roller after the sheet is conveyed toward the bend forming unit; wherein the position on the surface of the first bend forming roller is, out of a tangent line from a delivery position for delivering the sheet in a conveying unit that conveys the sheet toward the bend forming unit to a surface of the first bend forming roller, a contact point between a tangent line on a side of the second bend forming roller and a surface of the first bend forming roller.

10. The sheet processing method as recited in claim 9 further comprising:

forming the bend on the sheet without using a stopper in the conveyance path between the first pair of rollers and the second pair of rollers.

* * * * *